United States Patent [19]

Omelchuk

[11] Patent Number: 4,922,660

[45] Date of Patent: May 8, 1990

[54] PLYWOOD VENEER DRYER DOOR

[75] Inventor: John Omelchuk, Vernon, Canada

[73] Assignee: Crown Forest Industries Limited, Vancouver, Canada

[21] Appl. No.: 272,071

[22] Filed: Nov. 16, 1988

[51] Int. Cl.[5] ..... E05C 9/00

[52] U.S. Cl. ..... 49/395; 49/402; 34/242

[58] Field of Search ..... 34/242; 52/291, 404; 49/402, 394, 395

[56] References Cited

U.S. PATENT DOCUMENTS

| | | | |
|---|---|---|---|
| 2,027,083 | 1/1936 | Baer | 34/242 |
| 2,254,900 | 9/1941 | Lessmann | 34/242 |
| 2,999,366 | 9/1961 | La Fave et al. | 52/404 |
| 4,745,708 | 5/1988 | Roche | 49/395 |

*Primary Examiner*—Henry A. Bennet
*Assistant Examiner*—John Sollecito
*Attorney, Agent, or Firm*—Marger & Johnson, Inc.

[57] ABSTRACT

A door for sealing an aperture in a heated, pressurized chamber to prevent passage of gases through the aperture. A flexible door plate is sized to cover the aperture. A door frame is provided with frame members positionable around the circumference of one face of the door plate. Releasable fasteners are provided for releasably fastening the door plate and the door frame over the aperture to sandwich the door plate between the aperture and the door frame. A plurality of adjustable tightening members are disposed at intervals around the door frame for adjustably tightening the door frame against the door plate at each such interval.

3 Claims, 4 Drawing Sheets

PLYWOOD VENEER DRYER DOOR

FIELD OF THE INVENTION

This application pertains to a flexible door for sealing an aperture in a heated and/or pressurized chamber such as a plywood veneer dryer to prevent passage of gases through the aperture, while allowing for heat deformation of the door.

BACKGROUND OF THE INVENTION

Plywood veneer dryers are large, heated, pressurized chambers containing decks of vertically spaced rolls which transport veneer sheets horizontally through the dryer. Typical veneer dryers are approximately 100 feet in length. The atmosphere within the dryer chamber is heated to about 400° F. and circulated by large fans to remove moisture from the veneer sheets. Doors are provided on the sides of the dryer chamber to facilitate access to the chamber for clearing blockages which sometimes occur while veneer is transported through the dryer, and also to facilitate cleaning and maintenance of the dryer.

The dryer doors must be insulated and must seal tightly against the sides of the dryer in order to prevent gases from escaping past the door. Such escapement may result in heat loss and may also create an atmosphere outside the dryer which is irritating to personnel stationed near the dryer.

Prior art plywood veneer dryer doors are typically formed with metal frame and cross bracing members sandwiched between inner and outer door skins, with insulation placed between the skins and the frame members. Hinges are provided along one side of the door for pivotally mounting the door on the side of the dryer adjacent an aperture which is to be covered by the door. A latch arrangement is provided on the other side of the door for latching the door shut against the side of the dryer. A seal is provided around the inner lip of the door to sealingly engage between the doors and the door aperture. However, the rigid construction of prior art dryer doors, and the lack of any provision for adjustment thereof, makes it difficult to obtain a uniform seal around the perimeter of the door. Accordingly, prior art plywood veneer dryer doors often do not form a proper seal against the side of the dryer, resulting in escapement of gases from within the dryer and consequential heat loss and irritation to personnel stationed near the dryer. The present invention overcomes these problems.

SUMMARY OF THE INVENTION

In accordance with the preferred embodiment, the invention provides a door for sealing an aperture in a heated chamber to prevent passage of gases through the aperture. The door comprises a flexible door plate which is sized to cover the aperture, a door frame having frame members which are positionable around the circumference of one face of the door plate, releasable fastening means for releasably fastening the door plate and the door frame over the aperture to sandwich the door plate between the aperture and the door frame, and a plurality of adjustable tightening means disposed at intervals around the door frame for adjustably tightening the door frame against the door plate at each such interval.

Advantageously, the tightening means may comprise a first plurality of tightening members connected, at the intervals aforesaid, around the circumference of the door plate to project outwardly therefrom, an equal plurality of apertures disposed, at the intervals aforesaid, around the door frame, for passage therethrough of respective ones of the first tightening members, and a second plurality of tightening members, respectively engagable with the first plurality of tightening members, after passage of the first members through respective ones of the door frame apertures.

A third plurality of tightening members may be provided. These are respectively engaged with the first plurality of tightening members, for passage of the first members through respective ones of the door frame apertures. Preferably, the first plurality of tightening members are bolts and the second and third plurality of tightening members are nuts which are fastenable onto the bolts.

Advantageously, the door frame apertures may comprise cylindrical collars welded onto the door frame.

Thermal insulation is preferably sandwiched between the inner and outer door skins; and, a door seal is preferably disposed around the outer circumference of the door face for sealing engagement of the door with the aperture in the heated chamber.

DETAILED DESCRIPTION OF THE PREFERRED EMBODIMENT

Figure 2:
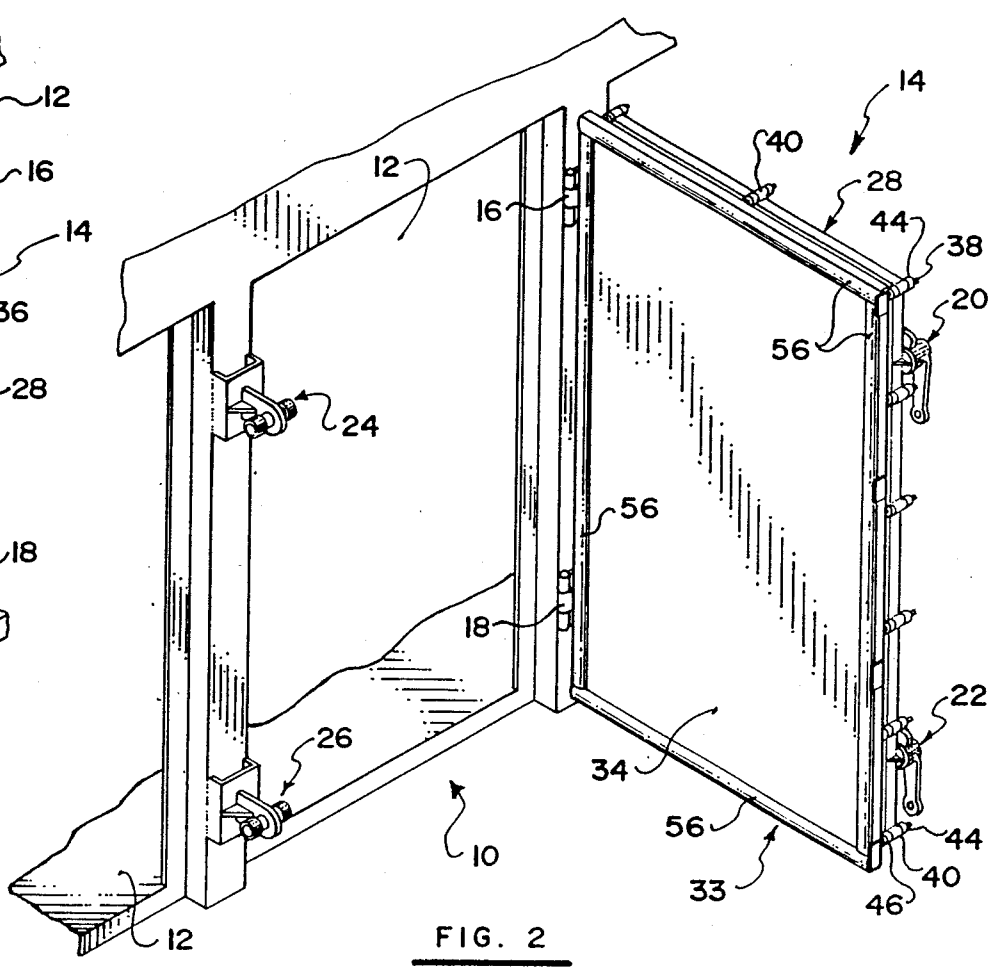
FIG. 2 is a pictorial view of the door of FIG. 1 in its open position.
Figure 1:
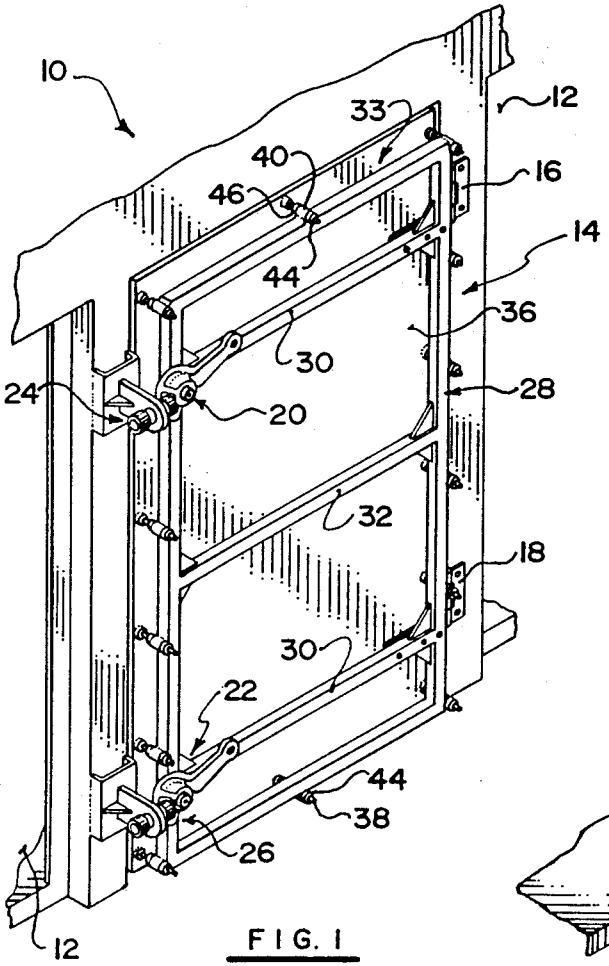
FIG. 1 is a pictorial illustration of a door constructed in accordance with the preferred embodiment of the invention and closed against the side of a plywood veneer dryer.

FIGS. 1 and 2 illustrate a heated, pressurized chamber; namely, a plywood veneer dryer 10 having an aperture 12 in its side. In practice, dryer 10 has a plurality of apertures 12 along each of its sides. These apertures facilitate access to the interior of dryer 10 to clear blockages which sometimes occur while veneer is transported through dryer 10 and also facilitate routine cleaning and maintenance of dryer 10. While dryer 10 is operational aperture 12 must be tightly sealed to prevent the escape of heated gases from within dryer 10. This is accomplished by means of door 14 which is pivotally mounted against the side of dryer 10 via hinges 16, 18. A pair of cam latches 20, 22 and cooperating wheel mechanisms 24, 26 are provided to secure door 14 against aperture 12. More particularly, cam latches 20, 22 are rotated in one direction to open door 14 and in the other direction to force door 14 tightly against aperture 12, sealing the aperture.

Figure 3:
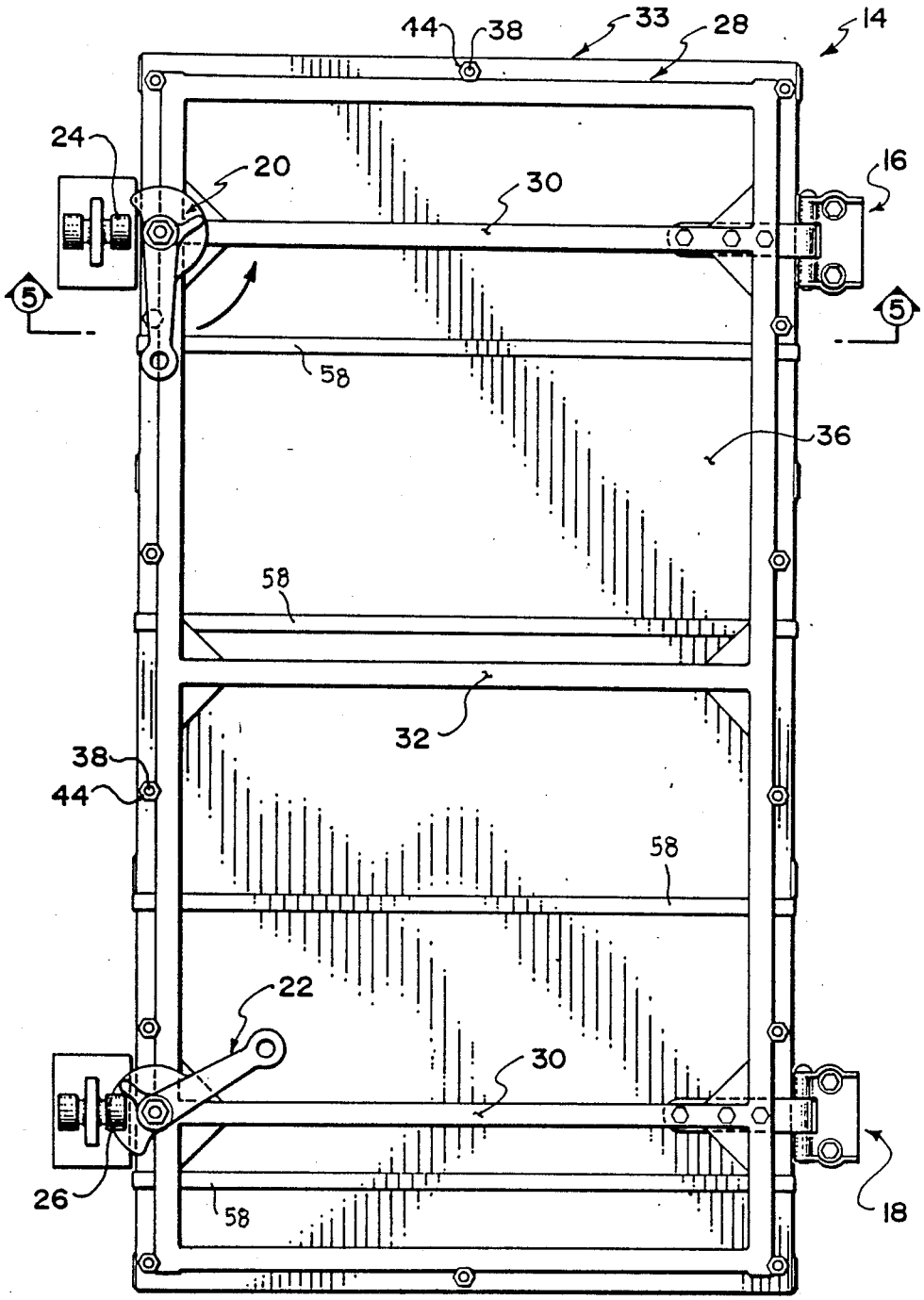
FIG. 3 is a plan view of the outer face of the door of FIG. 1.
Figure 4:
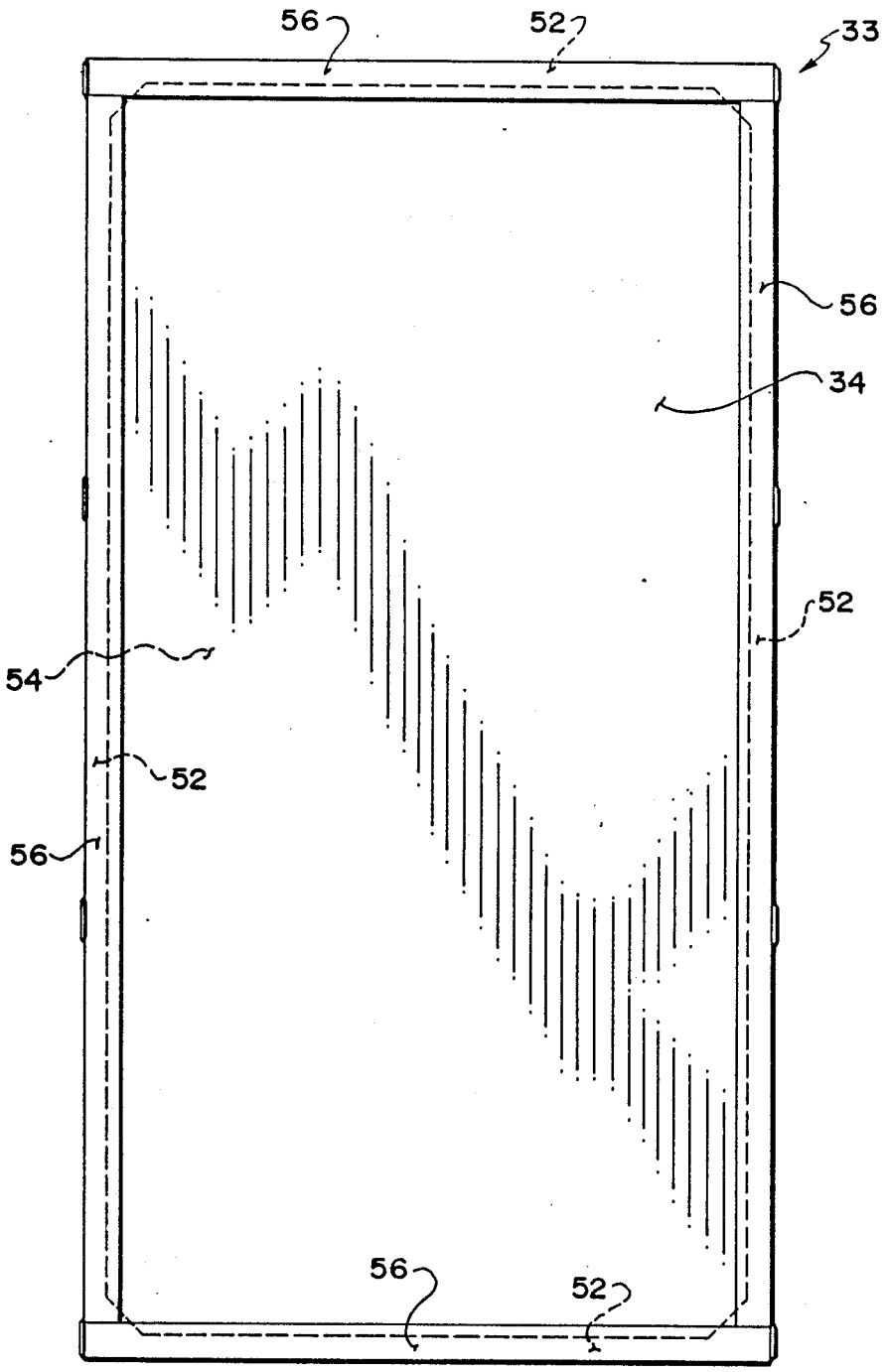
FIG. 4 is a plan view of the inner face of the door of FIG. 1.

As may be seen in FIG. 3, door 14 comprises a frame 28 formed of rectangular outer frame members and internal cross braces 30, 32. A flexible door plate 33 comprising thin inner and outer metal door skins 34, 36 respectively lies adjacent frame 28; the frame extending around the circumference of outer door skin 36. It will thus be understood that cam latches 20, 22 and wheel mechanisms 24, 26 together comprise a "releasable fastening means" for releasably fastening door plate 33 and door frame 28 over aperture 12 to sandwich door plate 33 between aperture 12 and door frame 28.

Figure 5:
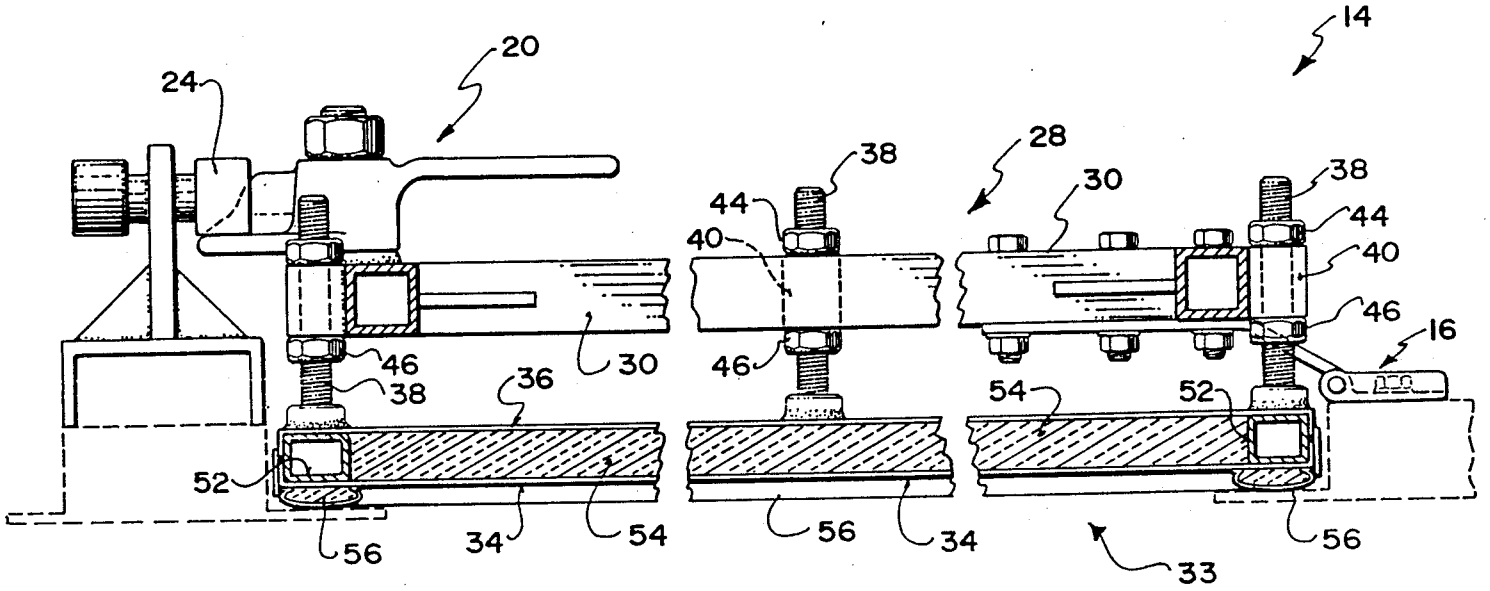
FIG. 5 is an enlarged, fragmented section view of the door, taken with respect to line 5—5 of FIG. 3.

As best seen in FIG. 5, a plurality of "adjustable tightening means" are provided at intervals around door frame 28 for adjustably tightening door frame 28 against door plate 33 at each such interval. The "adjustable tightening means" preferably comprise a first plurality of tightening members; namely, bolts 38, which are welded at intervals around the circumference of outer door skin 36 to project outwardly therefrom. The "adjustable tightening means" further comprises an equal plurality of apertures in the form of cylindrical collars 40 which are provided at intervals around door frame 28 so that each of bolts 38 may pass through one of the corresponding collar apertures. The "adjustable tightening means" further comprises a second plurality of tightening members; namely, nuts 44 which are fastenable onto bolts 38. A third plurality of tightening members; namely, nuts 46 are threaded onto bolts 38 before the bolts pass through collars 40. That is, nuts 46 are first threaded onto bolts 38, the bolts are then passed through collars 40 and then nuts 44 are threaded onto the protruding ends of the bolts.

Door plate 33 preferably comprises a pair of thin metal door skins 34, 36 which sandwich a thin, flexible frame 52. Thermal insulation material 54, such as inorganic mineral board, is placed in the spaces between. The door skins 34, 36 and flexible frame 52. A door seal 56 is provided around the outer circumference of inner door skin 34 to sealingly engage the outer rim of aperture 12.

"Venting means", namely open ended, "U" shaped channel members 58 (FIG. 3) are welded at spaced intervals across the face of outer door skin 36, with the open portion of each of members 58 facing inwardly. Outer door skin 36 comprises a plurality of discrete members which do not obstruct-the open, inwardly facing portions of members 58. Condensation which accumulates within insulation material 54 is thus able to escape, by evaporation, through the open portions of members 58 and is vented from the open ends of members 58. This minimizes corrosion of door plate 33 which would otherwise be caused by moisture trapped within insulation material 54.

In operation, door plate 33 tends to buckle as it is heated by contact with the hot gases within dryer 10. This buckling tends to disrupt the seal between door plate 33 and aperture 12. Corrective action may be taken by individually tightening or loosening each of nuts 44, 46 to bring door plate 33 back into sealing engagement with aperture 12 at each of the relatively closely spaced intervals around the door plate perimeter at which bolts 38 are located.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A door for sealing an aperture in a heated chamber to prevent passage of gases through said aperture, said door comprising:

(a) a flexible door plate sized to cover said aperture;

(b) a door frame having frame members positionable around the circumference of one face of said door plate;

(c) releasable fastening means for releasably fastening said door plate and said door frame over said aperture to sandwich said door plate between said aperture and said door frame; and, (d) a plurality of adjustable tightening means disposed at intervals around said door frame for adjustably tightening said door frame against said door plate at each of said intervals, said tightening means comprising:

(i) a first plurality of tightening members connected, at said intervals, around said door plate one face circumference, to project outwardly therefrom;

(ii) an equal plurality of apertures disposed, at said intervals, around said door frame, for passage therethrough of respective ones of said first tightening members;

(iii) a second plurality of tightening members, respectively engageable with said first plurality of tightening members, after passage of said first members through respective ones of said door frame apertures; and, (iv) a third plurality of tightening members, respectively engaged with said first plurality of tightening members, before passage of said first members through respective ones of said door frame apertures.

2. A door as defined in claim 1, wherein said first plurality of tightening members are bolts, and wherein said second and third plurality of tightening members are nuts threadably fastenable on said bolts.

3. A door as defined in claim 2, wherein said equal plurality of apertures respectively comprise cylindrical collars welded to said door frame.

* * * * *